US005767616A

United States Patent [19]

Kim

[11] Patent Number: 5,767,616

[45] Date of Patent: Jun. 16, 1998

[54] ELECTRON GUN SYSTEM FOR A COLOR CATHODE-RAY TUBE

[75] Inventor: Changhoe Kim, Seoul, Rep. of Korea

[73] Assignee: Samsung Display Devices Co., Ltd., Kyungki-do, Rep. of Korea

[21] Appl. No.: 743,127

[22] Filed: Nov. 1, 1996

[30] Foreign Application Priority Data

Nov. 24, 1995 [KR] Rep. of Korea ..... 95-43578

[51] Int. Cl.[6] ..... H01J 29/82

[52] U.S. Cl. ..... 313/456; 313/412; 313/414; 313/417

[58] Field of Search ..... 313/414, 412, 313/456, 457, 482, 417

[56] References Cited

U.S. PATENT DOCUMENTS 4,633,130 12/1986 McCandless ..... 313/456 X 4,952,840 8/1990 Hale et al. ..... 313/456

5,008,589 4/1991 Takanobu ..... 313/456

FOREIGN PATENT DOCUMENTS 0182648 9/1985 Japan ..... 313/456

*Primary Examiner*—Ashok Patel

*Attorney, Agent, or Firm*—Christie, Parker & Hale, LLP

[57] ABSTRACT

Disclosed is an electron gun which includes at least one pair of plate electrodes for focusing and accelerating thermal electrons, and at least one pair of cup-shaped focusing electrodes for focusing an electron beam coming out of plate electrodes, wherein the focusing electrodes have two or more electrodes embedded in a bead glass by means of fusing. The embedded electrodes are arranged perpendicularly to each other. A final focusing electrode has a cut groove at both ends, which contains the embedded electrodes. The inside of the final electrode is provided with an internal electrode having the embedded electrodes extended towards the outside through the cut grooves.

3 Claims, 3 Drawing Sheets

ELECTRON GUN SYSTEM FOR A COLOR CATHODE-RAY TUBE

BACKGROUND

The present invention relates to an electron gun for a color picture tube, and more particularly, to an electron gun which makes the realization of high picture quality possible.

Generally, an electron gun of a color CRT emits thermal electrons which are turned into electron beams that strike a phosphor layer, and produce an image. The electron gun consists of at least one pair of plate electrodes for accelerating and focusing the electrons, and at least one pair of cup-like electrodes for focusing the electron beam coming out of the plate electrodes.

Three electron beams emitted from the electron gun are converged and pass through a shadow mask. They are focused at one point and strike phosphor material of the screen. The thermal electrons that are emitted from a cathode are turned into beams, and as they pass through a plurality of electrodes, the electron beam through holes formed in the electrodes are aligned in the same line.

The in-line electron gun, has a single electrode with three apertures transversely arranged for passing the electron beam. As a results, the three converged electron beams interfere with one another resulting in transverse distortion of the electron beams. In order to minimize transverse distortion, there is provided a separate internal electrode with a small diameter in the main lens.

When the multiple electrodes are individually constructed sequentially arranged on a bead glass, it is very difficult to align the electron beam passages in the same line. In order to overcome this difficulty, the outer surface of the final electrode constituting the main focus lens is provided with a support member embedded in the bead glass to correct the electrode position.

Referring to FIG. 5 for illustrating the support member attached to the final electrode of the focus lens system embedded in the bead glass, sequentially embedded in the bead glass B are a first electrode G1, a second electrode G2, a third main focus electrode G3, and a fourth electrode G4. The support member 100 is welded to the outside of the fourth electrode G4 and is fork-shaped. However, the welding trace serves to pass the high voltage current applied to the fourth electrode towards the focus electrode, impairing the focusing of the electron beam. Moreover, the support member has the part embedded only transversely in the bead glass, making it difficult to secure a reliable embedding state. This is one of the causes impairing the alignment of the electrodes, resulting in low quality of the products.

SUMMARY

It is an objective of the present invention to provide a means for improving the alignment of the electrodes in an electron gun of a color cathode-ray tube.

It is another objective of the present invention to provide a means for preventing high voltage current from flowing towards a focus electrode through a welding trace.

According to the present invention, an electron gun comprises at least one pair of plate electrodes for focusing and accelerating thermal electrons, and at least one pair of cup-shaped focusing electrodes for focusing an electron beam coming out of the plate electrodes, wherein the focusing electrodes have two or more electrodes embedded in a bead glass by means of fusing. The embedded electrodes are arranged perpendicularly to each other. The final electrode of the focusing electrodes has a cut groove at both ends, which contains the embedded electrodes. The inside of the final electrode is provided with an internal electrode having the embedded electrodes extended towards the outside through the cut grooves.

BRIEF DESCRIPTION OF THE DRAWINGS

Further objectives and other advantages of the present invention will become apparent from the following description, appended claims, and accompanying drawings where:

DESCRIPTION

Embodiments will be described below in conjunction with the accompanying drawings.

Figure 1:
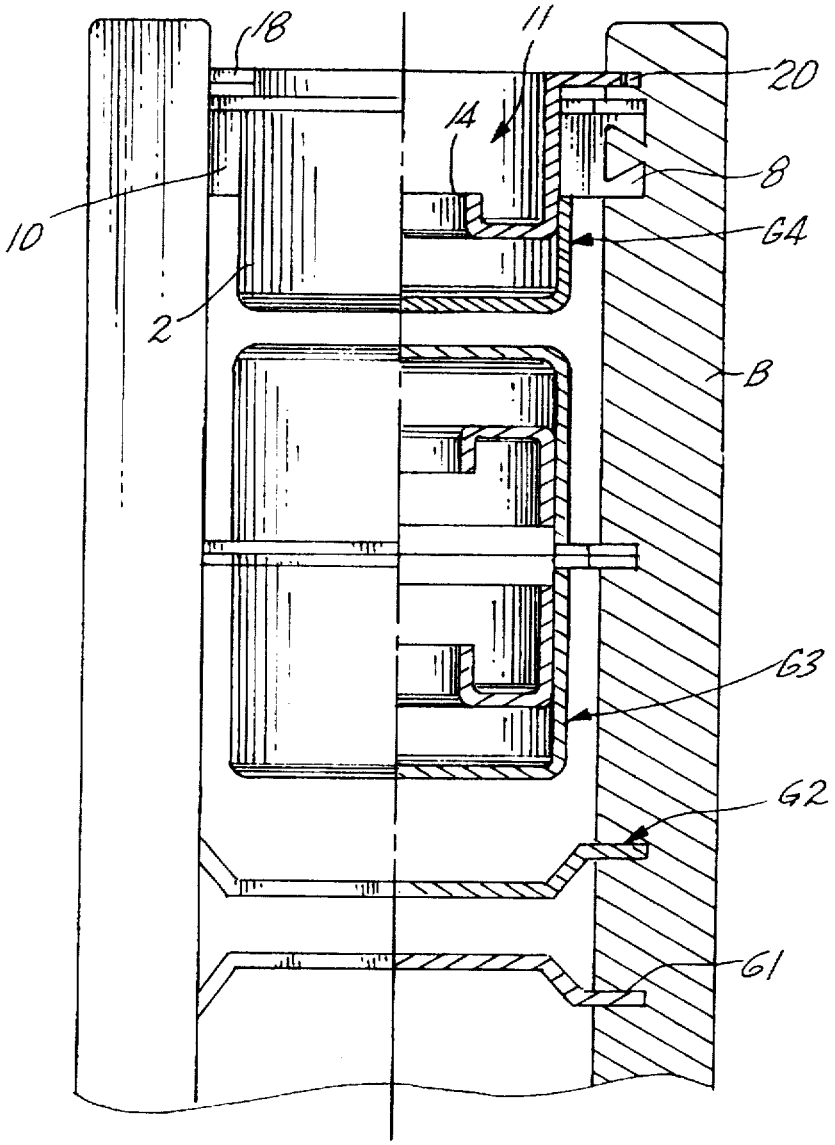
FIG. 1 is a cross-sectional view of an electron gun according to an embodiment of the present invention.
Figure 2:
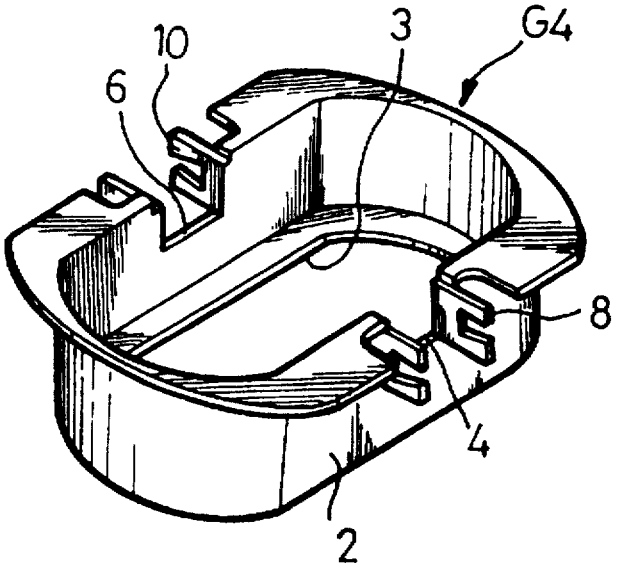
FIG. 2 is a perspective view of a final electrode.

Referring to FIG. 1, a bead glass "B" is provided sequentially with a first electrode G1, a second electrode G2, a third electrode G3, and a fourth electrode G4. The fourth electrode G4 consists of an electrode body 2 shaped like an elongated cup with a large common opening 3, as shown in FIG. 2. Each of the long sides of the electrode is provided with cut grooves 4, 6, both sides of which have embedded parts 8, 10 protruding perpendicular to the side walls of the electrode body. The cut grooves 4, 6 and the embedded parts 8, 10 may be formed by means of a pressing process.

Figure 3:
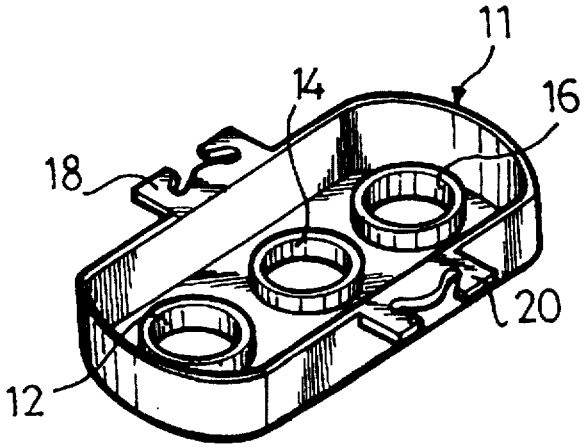
FIG. 3 is a perspective view for illustrating an internal electrode.
Figure 4:
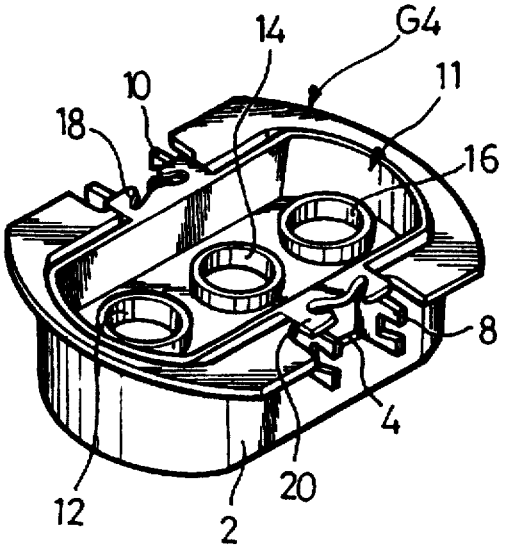
FIG. 4 is a perspective view for illustrating an internal electrode connected with a final electrode.
Figure 5:
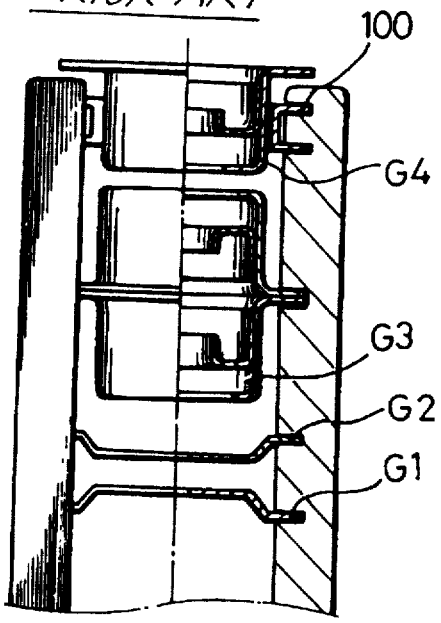
FIG. 5 PRIOR ART
FIG. 5 is schematic diagram for illustrating an in-line electron gun of a conventional color cathode-ray tube.

An internal electrode 11 is shaped like a cup having small diameter openings 12, 14, 16 separately formed, as shown in FIG. 3. The internal electrode has embedded parts 18, 20 'respectively' formed on the opposite side walls parallel to its bottom. Of course, the embedded parts 18, 20 of the internal electrode 11 may also be formed by means of a pressing process.

Assembling the fourth electrode G4 and the internal electrode 11, the embedded parts 18, 20 jut out through the cut grooves 4, 6 of the fourth electrode. Hence, the embedded parts 8, 10 in the bead glass and the embedded parts 18, 20 of the internal electrode 11 are horizontal. Thus, the embedment is firmly secured. Moreover, no welded support member is required to reinforce the embedment so that no weld trace occurs causing electrical current leakage.

As this type of embedment structure does not utilize a support member, reduction in operation efficiency is prevented and costs are reduced.

Although preferred embodiments of the present invention have been described in detail hereinabove, it should be clearly understood that many variations and/or modifications of the basic inventive concept herein taught which are apparent to those skilled in the present art will still fall within the spirit and scope of the present invention, as defined in the appended claims.

What is claimed is:

1. An electron gun for a color cathode ray tube having a focus electrode assembly, said focus electrode assembly, comprising:

a cup-shaped external electrode having a first open end and a second end having a hole for passage of red, green, and blue (R, G, B) electron beams, said cup-shaped external electrode having sides with opposing grooves adjacent the second end, and first embedded parts for embedment in a bead glass, the first embedded parts extending from said grooves; and a cup-shaped internal electrode having a first open end and a second end having three holes, each of the three holes passing one of said R, G, B beams, said cup-shaped internal electrode being disposed in said external cup-shaped electrode such that the cup-shaped external electrode hole is spaced apart from the three holes of the cup-shaped internal electrode for focusing the R, G, B beams, said cup-shaped internal electrode having second embedded parts for embedment in the bead glass, the second embedded parts being formed on opposite sides of the second end and positioned to correspond to said first embedded parts.

2. The electron gun as defined in claim 1 wherein said first and second embedded parts of the focusing electrode assembly are arranged perpendicular to each other.

3. The electron gun as defined in claim 1 further comprising a cathode for emitting said R, G, B beams toward the focus electrode assembly.

* * * * *